US006546763B1

(12) United States Patent
Pielach

(10) Patent No.: US 6,546,763 B1
(45) Date of Patent: Apr. 15, 2003

(54) LOCK ASSEMBLY

(76) Inventor: Jeffrey A. Pielach, 3048 S. Joslyn, Mesa, AZ (US) 85212

( * ) Notice: Subject to any disclaimer, the term of this patent is extended or adjusted under 35 U.S.C. 154(b) by 0 days.

(21) Appl. No.: 10/020,852

(22) Filed: Nov. 30, 2001

(51) Int. Cl.[7] ..... E05B 73/00; E05B 67/02; E05B 67/06

(52) U.S. Cl. ..... 70/38 C; 70/18; 70/52; 70/53; 292/315

(58) Field of Search ..... 70/18, 52, 53, 70/38 R, 38 C; 292/315, 330, 253, DIG. 16

(56) References Cited

U.S. PATENT DOCUMENTS 3,330,586 A * 7/1967 Becker ..... 292/315
4,290,279 A * 9/1981 Fish et al. ..... 292/315
4,841,753 A * 6/1989 Patton ..... 70/38 A
4,938,039 A * 7/1990 Tzung-I ..... 70/38 C

* cited by examiner

*Primary Examiner*—Anthony Knight
*Assistant Examiner*—Michael J. Kyle
(74) *Attorney, Agent, or Firm*—John D. Lister

(57) ABSTRACT

A lock assembly includes an elongated generally U-shaped resilient shackle, a base block, and may also include a keyed auxiliary locking bar. A first shackle arm is slidably and rotatably secured to the base block so that the shackle can be moved between extended and depressed positions and pivoted between locked and unlocked positions. The base block includes a catch for retaining a second shackle arm in the locked position. To pivot the shackle so that the second shackle arm can be moved into or out of the catch, the second shackle arm must be flexed toward the first shackle arm. When the shackle is in the locked position, a locking mechanism holds the shackle in the extended position and requires the shackle to be depressed, while the second shackle arm is flexed, to pivot the shackle and move the second shackle arm out of the catch.

15 Claims, 2 Drawing Sheets

FIG. 1
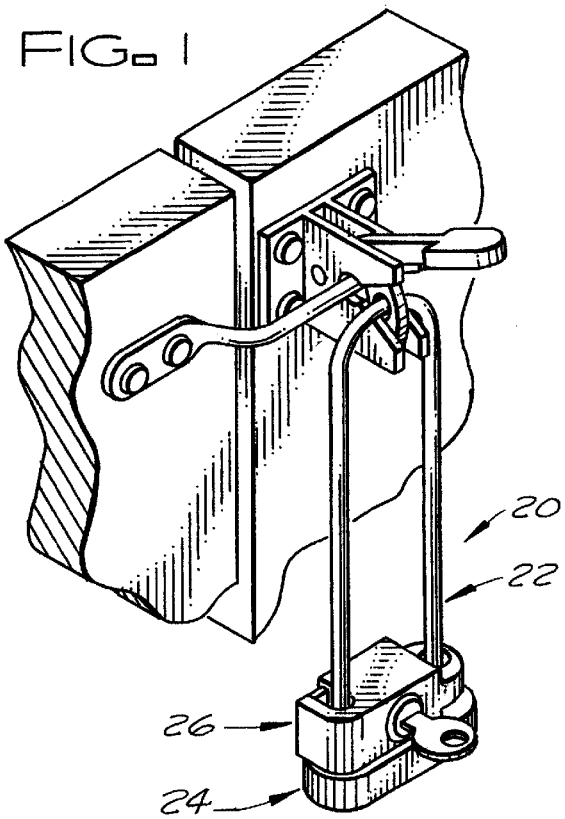
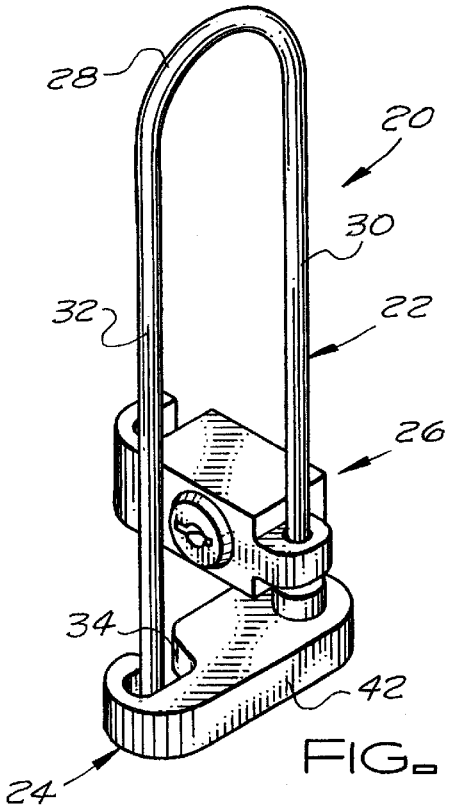
FIG. 2
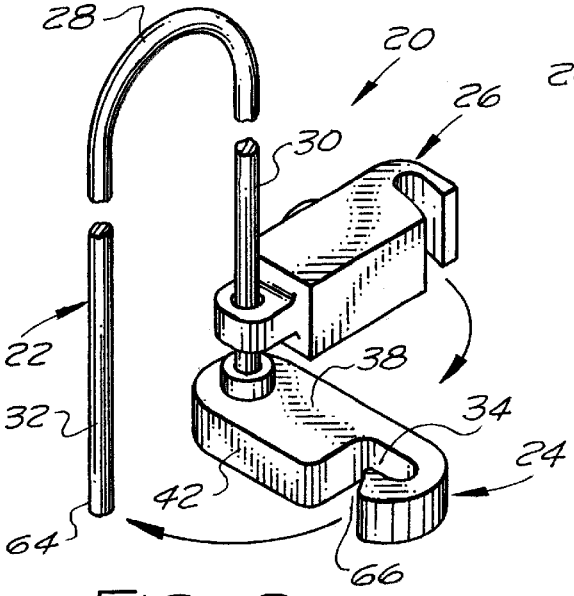
FIG. 3
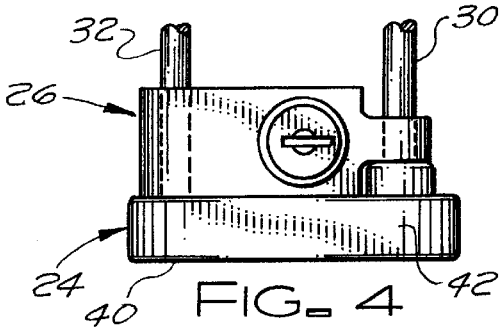
FIG. 4
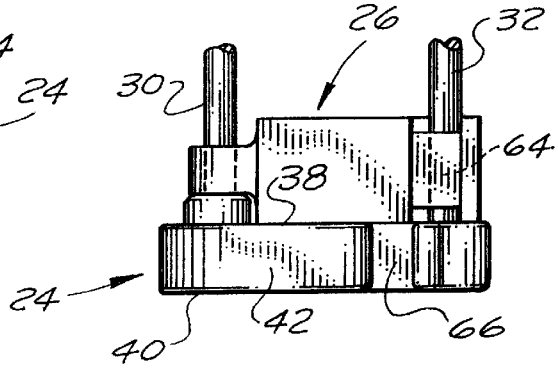
FIG. 5

FIG. 6
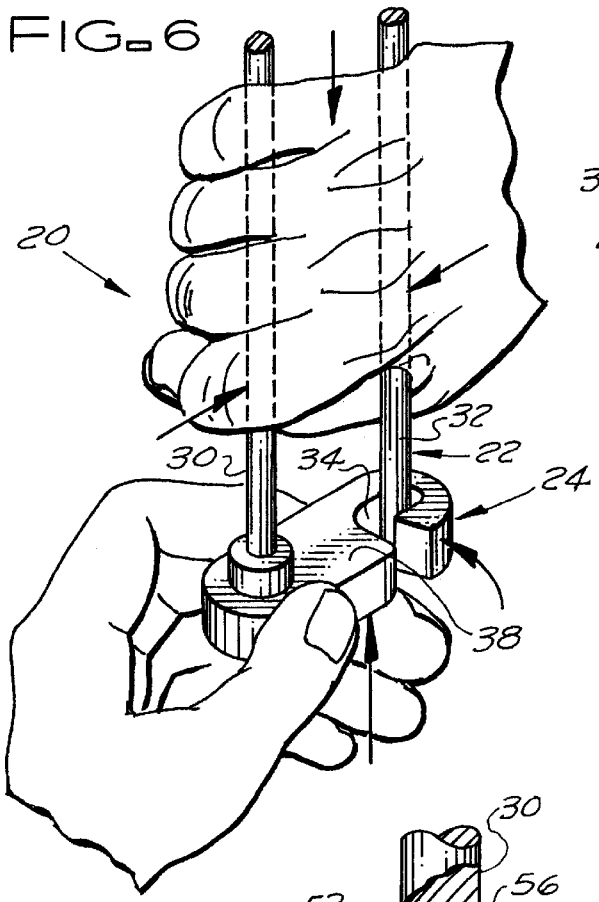
FIG. 7
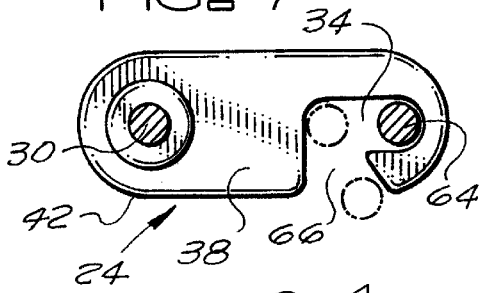
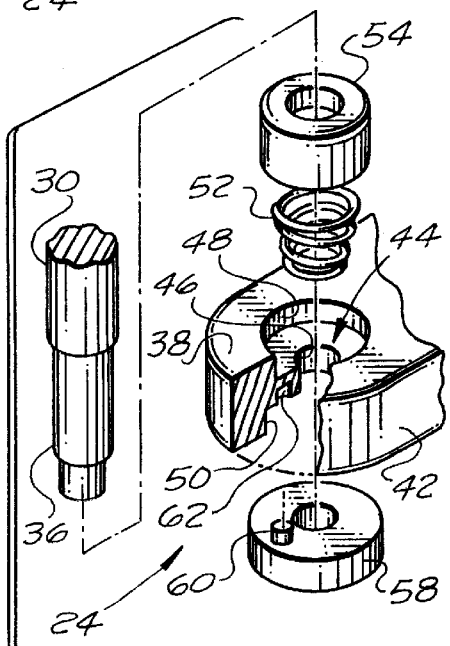
FIG. 8
FIG. 9
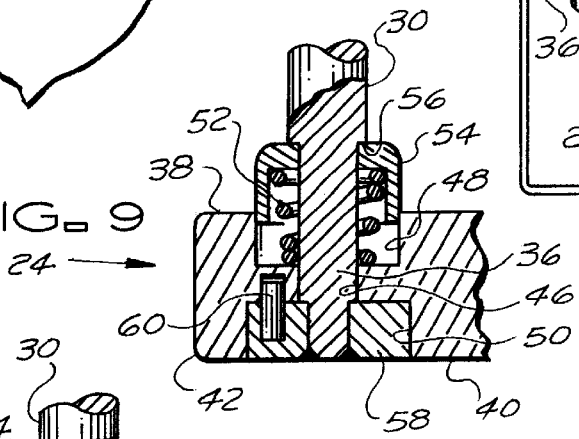
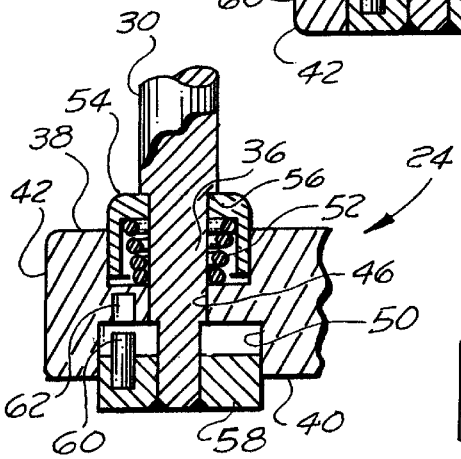
FIG. 10
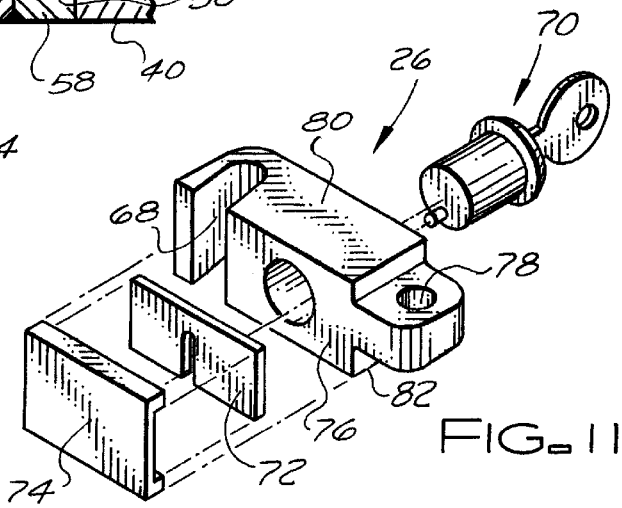
FIG. 11

LOCK ASSEMBLY

BACKGROUND OF THE INVENTION

The subject invention relates to a lock assembly and in particular to a lock assembly that, although essentially toddler proof, can be locked or unlocked by an adult without the need to use a key or to remember and punch a code into a keypad. While the lock assembly of the subject invention has many applications, the lock assembly of the subject invention is particularly well suited for applications where there is a need to keep toddlers from gaining access to an area, such as a swimming pool, where the toddler may come to harm or from gaining access to the contents of a cabinet, trunk, closet or storage area that may contain substances harmful to the toddler or other objects best kept out of the hands of toddlers.

The Consumer Product Safety Commission, in its publication entitled "Safety Barrier Guidelines for Home Pools", CPSC Document #362, states that "Each year, hundreds of young children die and thousands come close to death due to submersion in residential swimming pools." CPSC has estimated that each year about 300 children under 5 years old drown in residential swimming pools. The Commission estimates that hospital emergency room treatment is required for approximately another 2,300 children less than 5 years of age who were submerged in residential pools.

In an extensive study performed by CPSC in California, Arizona and Florida in the late 1980's, drowning was the leading cause of accidental death in and around the home for children under the age of 5 years. Of children in this age category, 75% of the children involved in swimming pool submersion or drowning accidents were between 1 and 3 years old. Nearly 69% of the children under 5 years of age involved in submersion or drowning accidents were last seen in the house, on the porch or patio, or in the yard prior to the accident and were not expected to be in or at the pool and 77% of the children involved in submersion or drowning accidents had been missing for five minutes or less. Approximately, 98% of submersion or drowning accidents involving children less than 5 years of age occurred in a pool owned by the victim's immediate family, relatives or friends.

The CPSC Document #362, further states:

"The speed with which swimming pool drownings and submersions can occur is a special concern: by the time a child's absence is noted, the child may have drowned. Anyone who has cared for a toddler knows how fast young children can move. Toddlers are inquisitive and impulsive and lack a realistic sense of danger. These behaviors, coupled with a child's ability to move quickly and unpredictably, make swimming pools particularly hazardous for households with young children.

Swimming pool drownings of young children have another particularly insidious feature: these are silent deaths. It is unlikely that splashing or screaming will occur to alert a parent or caregiver that a child is in trouble."

As a result of these guidelines, municipal laws and regulations, and the natural desire for parents to protect their children, most home swimming pools are enclosed within a gated barrier to prevent toddlers from gaining access to the pool areas. However, frequently, the gates of these gated barriers, while latched by the parent or caregiver when they are not in use or are being used intermittently, are not locked by the parent or caregiver due to need to carry a key, know or remember a keypad code, etc. Thus, while these unlocked gated barriers function as an impediment to a young child gaining access to a pool area, the inquisitive, impulsive, unpredictable nature of young children coupled with their uncanny ability to find a way to open something, make these swimming pool barriers susceptible to unsupervised toddler access due to the ability of some children to find a way to unlatch the gate.

In addition to swimming pool hazards, homes typically have substances, e.g. paints, turpentine, cleaners, insecticides, gasoline, etc, that should be kept out of a toddler's possession. These substances are normally stored in a shed, cabinet, or storage area. Again the need to lock these storage locations to prevent toddler access is essential to the safety of these young children.

Thus, to prevent children under 5 years of age from gaining access to areas or substances that can harm the children or cause their accidental death, there has been a long term need to provide a lock assembly that cannot be unlocked by these young children but can be easily locked or unlocked by an adult without the need for a key or the need to know or remember a keypad code.

SUMMARY OF THE INVENTION

The lock assembly of the subject invention can be made so that the lock assembly cannot be unlocked by young children, e.g. children under 5 years of age, but can be easily locked or unlocked by an adult without the need for a key or the need to know or remember a keypad code. In addition to providing a solution for restricting toddler access to certain areas or storage locations, the lock assembly of the subject invention is relatively inexpensive, durable and easy to maintain.

The lock assembly of the subject invention includes an elongated generally U-shaped shackle and a base block. The generally U-shaped shackle has a midsection and first and second arms extending from the midsection. An end portion of the first shackle arm is slidably and rotatably secured to the base block so that the shackle can be moved relative to the base block between an extended position and a depressed position and pivoted relative to the base block between a closed or locked position and an open or unlocked position. The second shackle arm is resilient whereby the end portion of the second shackle arm can be flexed from a first position toward the first shackle arm by applying a force to the second shackle arm that is directed toward the first arm and, when the force is released, the second shackle arm returns to the first position. The base block also includes a catch for receiving and retaining the end portion of the second shackle arm in the closed or locked position. To pivot the shackle so that the end portion of the second shackle arm can be moved into the catch to place the shackle in the closed or locked position or out of the catch to place the shackle in the open or unlocked position, the end portion of the second shackle arm must be flexed toward the first shackle arm.

When the shackle is in the closed or locked position, a locking mechanism retains the shackle in both the extended position and the closed or locked position. To release the locking mechanism so that the shackle can be pivoted to move the end portion of the second shackle arm out of the catch and the shackle to the open or unlocked position, the shackle must be depressed from the extended position to the depressed position and held in the depressed position while the end portion of the second shackle arm is simultaneously flexed toward the first shackle arm. If these operations are not performed simultaneously, the shackle cannot be pivoted from the closed or locked position to the open or unlocked position. The lock assembly of the subject invention can be fabricated so that the force required to move the end portion of the second shackle arm toward the first shackle arm (the force needed to squeeze the shackle arms toward each other) plus the force required to depress the shackle to release the locking mechanism are such that a child under the age of 5 years would not have the strength required to perform these operations simultaneously, could not perform these operations simultaneously, and could not unlock the lock assembly.

The lock assembly of the subject invention can also include an auxiliary locking bar, a cross bar, that can be mounted on the shackle to keep the arms of the shackle from being squeezed toward each other when the shackle is in the locked positioned. The auxiliary locking bar has a catch therein for receiving one of the shackle arms and a keyed locking mechanism for locking the received shackle arm within the catch of the auxiliary locking bar. The auxiliary locking bar also has an opening there through for receiving the other of the shackle arms so that the auxiliary locking bar can be pivoted relative to the other shackle arm between a first position where the one shackle arm is outside of the catch in the auxiliary locking bar and a second position where the one shackle arm is within the catch of the auxiliary locking bar. The catch of the auxiliary locking bar and the opening there through are spaced from each other a distance such that, when the one shackle arm is locked within the catch of the auxiliary locking bar, the lower end portion of the second shackle arm cannot be flexed toward the first shackle arm a distance sufficient to permit the lower end portion of the second shackle arm to be pivoted out of the catch in the base block. Thus, for example, a pool owner, who desires to have a barrier gate that cannot be opened without a key or a pool owner who is away and desires to lock a barrier gate so that the barrier gate cannot be opened without a key, can use the lock assembly of the subject invention with the auxiliary locking bar in place and locked with a key to retain the shackle of the lock assembly in the locked position.

BRIEF DESCRIPTION OF THE DRAWINGS

FIG. 1 is a perspective view of a barrier gate with the lock assembly of the subject invention, including the auxiliary locking bar, secured to the gate latch.

FIG. 2 is a perspective view of the lock assembly of the subject invention with the shackle of the lock assembly in the closed or locked position and the auxiliary locking bar mounted on the lock assembly in an unlocked position.

FIG. 3 is a perspective view of the lock assembly of the subject invention with the shackle of the lock assembly in the open or unlocked position and the auxiliary locking bar mounted on the lock assembly in an unlocked position.

FIG. 4 is a partial side elevation of a first side the lock assembly of the subject invention with the shackle of the lock assembly in the closed or locked position and the auxiliary locking bar mounted on the lock assembly in a locked position.

FIG. 5 is a partial side elevation of a second side of the lock assembly of the subject invention with the shackle of the lock assembly in the closed or locked position and the auxiliary locking bar mounted on the lock assembly in a locked position.

FIG. 6 is a partial perspective view of the lock assembly of the subject invention, without the auxiliary locking bar, showing the arms of the shackle being squeezed toward each other and the shackle being depressed relative to the base block.

FIG. 7 is a horizontal cross section through the lock assembly of the subject invention, immediately above the base block, showing, in phantom line, the lower portion of the second arm being moved into or out of the catch in the base block.

FIG. 8 is an exploded perspective view of the mounting and locking mechanism of the subject invention for slidably and rotatably mounting the first arm of the shackle in the base block.

FIG. 9 is a partial vertical cross section through the base block of the lock assembly of the subject invention with the shackle in the extended position and the first arm of the shackle locked against rotation so the shackle cannot pivot.

FIG. 10 is a partial vertical cross section through the base block of the lock assembly of the subject invention with the shackle in the depressed position and the first arm of the shackle unlocked and free to rotate so the shackle can be pivoted.

FIG. 11 is an exploded perspective view of the auxiliary locking bar of the subject invention for locking the shackle in the catch of the base block.

DESCRIPTION OF THE PREFERRED EMBODIMENT

As shown in FIGS. 1 to 5, the lock assembly 20 of the subject invention includes an elongated generally U-shaped shackle 22 and a base block 24, and may also include an auxiliary locking bar 26.

The generally U-shaped shackle 22 has a midsection 28 and a first arm 30 and a second arm 32 that both extend in the same direction from the midsection 28. An end portion of the first shackle arm 30 is slidably and rotatably secured to the base block 24 so that the shackle 22 can be moved relative to the base block 24 between an extended position and a depressed position and pivoted relative to the base block 24 between a closed or locked position and an open or unlocked position. At least the second shackle arm 32 is resilient whereby the second shackle arm 32 can be flexed from a first position toward the first shackle arm 30 by applying a force to the second shackle arm 32 that is directed toward the first shackle arm 30 and, when the force is released, the second shackle arm 32 returns to the first position. The base block 24 also includes a catch 34 for receiving and retaining an end portion of the second shackle arm 32 in the closed or locked position.

The mounting of the reduced diameter end portion 36 of the first shackle arm 30 in the base block 24 is shown in FIGS. 8 to 10. The base block 24 has a first surface 38, a second surface 40 and lateral surfaces and end surfaces 42 extending between the first and second surfaces and defining edges of the first and second surfaces. A hole 44 for slidably and rotatably receiving the reduced diameter end portion 36 of the shackle arm 30 is located adjacent a first end of the base block 24 and passes completely through the base block 24 from the first surface 38 to the second surface 40 of the base block. The hole 44 in the base block has a reduced diameter cylindrical midportion 46 with larger diameter cylindrical end portions 48 and 50 adjacent the first and second surfaces 38 and 40 of the base block 24. These larger diameter cylindrical end portions 48 and 50 of the hole 44 form cylindrical cavities in the first and second surfaces of the base block. The reduced diameter end portion 36 of the first shackle arm 30 is slidably and rotatably received within the hole 44 and passes from the first surface to the second surface of the base block through the reduced diameter midportion 46 of the hole 44.

Preferably, the hole 44 contains a locking mechanism for preventing pivotal movement of the shackle 22 when the shackle is in the closed or locked position. The locking mechanism includes a coil spring and spring cap plus a catch pin and catch pin hole. The cavity in the first surface 38 of the base block 24, formed by the enlarged diameter cylindrical end portion 48 of the hole 44 in the base block, houses the coil spring 52 and the spring cap 54. The coil spring 52 and the spring cap 54 are mounted on the reduced diameter end portion 36 of the first shackle arm 30. The spring cap 54 abuts and is held in place by a shoulder 56 formed between the reduced diameter end portion 36 of the first shackle arm 30 and the remainder of the first shackle arm 30. The coil spring 52 extends between a base surface of the cavity in the first surface 38 of the base block and the spring cap 54 and exerts a force on the spring cap 54 that is transferred through the spring cap 54 to the first shackle arm 30 to normally hold the shackle 22 in the extended position.

The cavity in the second surface 40 of the base block 24, formed by the enlarged diameter cylindrical end portion 50 of the hole 44 in the base block, houses the end cap or collar 58 with the catch pin 60. The end cap or collar 58 is welded or otherwise secured to the end of the first shackle arm 30. The catch pin 60 is secured to the end cap or collar 58 and extends from the end cap or collar 58 toward the first surface 38 of the base block 24. The base of the cavity in the second surface 40 of the base block 24 contains the catch pin hole 62 for receiving the catch pin 60 when the shackle 22 is in the closed or locked position and, when the shackle 22 is in the closed or locked position, the force exerted on the first shackle arm 30 by the coil spring 52 through the spring cap 54 urges the catch pin 60 into the catch pin hole 62 to lock the shackle in the closed or locked position. With this structure, the shackle 22 must be depressed, to remove the catch pin 60 from the catch pin hole 62, before the shackle can be pivoted about the first shackle arm 30. While, as shown, the catch pin 60 is mounted in the end cap or collar 58 and the catch pin hole 62 is located in the base of the cavity formed in the second surface of the base block, the catch pin 60 can be mounted in the base of the cavity formed in the second surface of the base block and the catch pin hole 62 can be located in the end cap or collar 58. In addition, while it is preferred to utilize a catch pin 60 for the latch and a catch pin hole 62 for the latch receiver to lock the first shackle arm 30 against rotation, other latches and latch receivers may be utilized to lock the first shackle arm 30 against rotation provided these latches and latch receivers require the shackle to be depressed to enable the shackle to be pivoted about the first shackle arm 30 and otherwise perform the locking function of the catch pin 60 and catch pin hole 62.

The catch 34 for receiving and retaining the end portion 64 of the second shackle arm 32 in the closed or locked position is located in the base block 24 adjacent the second end of the base block. As best shown in FIG. 7, preferably, the catch 34 is generally L-shaped and has an opening 66, that opens onto one of the lateral side surfaces of the base block, through which the end portion 64 of the second shackle arm 32 must pass to be moved into or out of the catch 34. The spacing between the opening 66 of the catch 34 and the hole 44 that slidably and rotatably retains the first shackle arm 30 is such that the end portion 64 of the second shackle arm 32 must be flexed and moved toward the first shackle arm 30 for the end portion 64 of the second shackle arm to pass through the opening 66. Accordingly, to pivot the shackle 22 so that the end portion 64 of the second shackle arm 32 can be moved through the opening 66 into the catch 34 to place the shackle 22 in the closed or locked position or out of the catch 34 to place the shackle 22 in the open or unlocked position, the end portion 64 of the second shackle arm 32 must be flexed toward the first arm of the shackle e.g. by squeezing the shackle arms together.

As discussed above, when the shackle 22 is in the closed or locked position, the locking mechanism for holding the shackle 22 in the closed or locked position holds the shackle 22 in the extended position relative to the base block 24 with the catch pin 60 in the catch pin hole 62. Accordingly, to release the shackle 22 so that the shackle 22 can be pivoted from the closed or locked position to the open or unlocked position, the shackle 22 must to be moved to the depressed position and held in the depressed position to remove or disengage the catch pin 60 from the catch pin hole 62 and the end portion 64 of the second shackle arm 32 must be flexed toward the first shackle arm 30, e.g. by squeezing the shackle arms together. When both of these operations are performed simultaneously as shown in FIG. 6, the pivotal movement of the shackle 22 to move the end portion 64 of the second shackle arm 32 out of the catch 34 can be initiated.

In a preferred embodiment of the lock assembly 20, the shackle 22 is made of 300 series stainless steel, the base block 24 is made of 6061-T6 aluminum hard anodize Type III or 300 series stainless steel, the coil spring 52 is made of zinc plated spring steel, the spring cap is made of 6061-T6 aluminum hard anodize Type III or 300 series stainless steel, the end cap or collar 58 is made of 300 series stainless steel, and the catch pin 60 is made of 300 series stainless steel. These materials make the lock assembly 20 corrosion resistant and the lock assembly will have years of outdoor service life. In the preferred embodiment of the lock assembly 20 the shackle 22 is made of a 0.25 inch diameter rod, the center to center spacing of the first and second shackle arms 30 and 32 is about 1.35 inches, and the first and second arms 30 and 32 are about 5.2 inches in length. The distance from the center of hole 44 in the base block 24 within which the end portion of the first shackle arm 30 is slidably and rotatably mounted to the center of opening 66 of the catch 34 in the base block through which the end portion of the second shackle arm 32 must pass to pivot the second shackle arm 32 into or out of the catch 34 is about 1.18 inches. For the end portion of the second shackle arm 32 to pass through the opening 66 of the catch 34, the end portion of the second shackle arm 32 must be moved toward the first shackle arm about 0.17 inches e.g. by squeezing the shackle arms toward each other. It should be noted that while the materials, component sizes and the dimensions set forth in this paragraph are the preferred materials, component sizes and dimensions for the lock assembly 20, the lock assembly 20 can be made of other materials, with different component sizes, and/or with different dimensions provided such materials, component sizes and/or dimensions cooperate to produce a functionally equivalent lock assembly.

The lock assembly 20 can also include the auxiliary locking bar 26, a cross bar, that can be mounted on the shackle 22 to keep the shackle arms 30 and 32 from being moved or squeezed toward each other when the shackle 22 is in the locked positioned. The auxiliary locking bar 26 has a first surface and a second surface and lateral surfaces and end surfaces that define the edges of the first and second surfaces of the auxiliary locking bar. The auxiliary locking bar 26 has a catch 68 therein for receiving one of the shackle arms 30 and 32 and a keyed lock mechanism, e.g. a conventional cylinder lock 70 with a cam operated sliding closure bar 72, for locking the one shackle arm within the catch 68. The cylinder lock is contained within a hole in the auxiliary locking bar and the cam operated sliding bar 72 is slidably retained in a channel shaped cover plate 74 welded or otherwise secured to the main body 76 of the auxiliary locking bar 26. When the closure bar 72 is moved to an extended position by the cylinder lock 70, as shown in FIG. 5, the opening of the catch 68 is closed by the bar to retain the one shackle arm within the catch. When the closure bar 72 is moved to a retracted position by the cylinder lock 70, shown in FIGS. 2 and 3, the opening of the catch 68 is opened so that the one shackle arm can be moved out of or into the catch 68. The auxiliary locking bar 26 has an hole 78 passing completely there through from the first surface 80 to the second surface 82 of the locking bar for receiving the other of the shackle arms 30 and 32 so that the auxiliary locking bar 26 can be pivoted relative to the other shackle arm between a first position where the one shackle arm is outside of the catch 68 in the auxiliary locking bar 26 and a second position where the one shackle arm is within the catch 68 of the auxiliary locking bar 26. The catch 68 of the auxiliary locking bar 26 and the hole 78 are spaced from each other a distance such that, when the one shackle arm is locked within the catch 68 of the auxiliary locking bar, the lower end portion of the second shackle arm 32 cannot be flexed toward the first shackle arm a distance sufficient to permit the lower end portion 64 of the second shackle arm 32 to be pivoted out of the catch 34 of the base block 24. While the auxiliary locking bar 26 can be permanently mounted on the shackle 22, preferably, the auxiliary locking bar 26 may be slid onto or off of the shackle either of the shackle arms. When the auxiliary locking bar 26 is in use, the one shackle arm is retained within the catch 68, the auxiliary locking bar is mounted on the other shackle arm, and the cylindrical lock 70 of the keyed locking mechanism is locked with the sliding bar 72 of the mechanism extended to close the opening to the catch 68.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A lock assembly comprising:

an elongated generally U-shaped shackle with a midsection and first and second arms extending from the midsection; the first shackle arm having an end portion and the second shackle arm having an end portion; the second shackle arm being resilient whereby the end portion of the second shackle arm can be flexed from a first position toward the first shackle arm by applying a force to the second shackle arm that is directed toward the first shackle arm and the second shackle arm returns to the first position when the force is released;

a base block; the base block having a first surface and a second surface; the base block having lateral surfaces and end surfaces extending between the first and second surfaces and defining edges of the first and second surfaces; the base block having means for slidably and rotatably securing the end portion of the first shackle arm to the base block so that the shackle can be moved relative to the base block between an extended position and a depressed position and pivoted relative to the base block between a closed position and an open position; the base block having a catch means for receiving and retaining the end portion of the second shackle arm; the catch means requiring the end portion of the second shackle arm to be flexed toward the first shackle arm for the end portion of second shackle arm to be pivoted into the catch means to place the shackle in the closed position and for the end portion of the second shackle arm to be pivoted out of the catch means to place the shackle in the open position; and a locking means for holding the shackle in the closed position that holds the shackle in the extended position relative to the base block when the shackle is in the closed position and requires the shackle to be moved to the depressed position and held in the depressed position, while the end portion of the second shackle arm is flexed toward the first shackle arm, to initiate the pivotal movement of the end portion of the second shackle arm out of the catch means.

2. The lock assembly according to claim 1, wherein:

the locking means comprises a latch; a latch receiver that receives the latch when the shackle is in the closed and extended position to keep the shackle from pivoting; and a spring for biasing the shackle toward the extended position that holds the shackle in the extended position when the shackle is in the closed position and that can be compressed to withdraw the latch from the latch receiver so that the shackle can be pivoted from the closed position.

3. The lock assembly according to claim 2, wherein:

the latch is carried on a collar of the end portion of the first shackle arm and rotates with the first shackle arm; and the latch receiver is in the base block.

4. The lock assembly according to claim 2, wherein:

the latch is a pin and the latch receiver is a cavity sized to receive the pin.

5. The lock assembly according to claim 4, wherein:

the pin is carried on a collar of the end portion of the first shackle arm and rotates with the first shackle arm; and the cavity is in the base block.

6. The lock assembly according to claim 1, wherein:

the locking means is keyless.

7. The lock assembly according to claim 1, wherein:

the catch means is a generally L-shaped cutout opening onto one of the lateral surfaces of the base block.

8. The lock assembly according to claim 7, wherein:

the locking means comprises a latch; a latch receiver that receives the latch when the shackle is in the closed and extended position to keep the shackle from pivoting; and a spring for biasing the shackle toward the extended position that holds the shackle in the extended position when the shackle is in the closed position and that can be compressed to withdraw the latch from the latch receiver so that the shackle can be pivoted from the closed position.

9. The lock assembly according to claim 8, wherein:

the latch is a pin and the latch receiver is a cavity sized to receive the pin.

10. The lock assembly according to claim 9, wherein:

the pin is carried on a collar of the end portion of the first shackle arm and rotates with the first shackle arm; and the cavity is in the base block.

11. The locking assembly according to claim 1, including:

an auxiliary locking bar mounted on the shackle; the auxiliary locking bar having a first surface and a second surface; the auxiliary locking bar having lateral surfaces and end surfaces defining edges of the first and second surfaces of the auxiliary locking bar; the auxiliary locking bar having a catch therein for receiving one of the first and second arms of the shackle and a keyed locking mechanism for locking the received arm within the catch of the auxiliary locking bar; the auxiliary locking bar having an opening there through passing from the first to the second surface of the auxiliary locking bar for receiving the other of the first and second arms of the shackle so that the auxiliary locking bar can be pivoted relative to the other arm of the shackle between a first position where the one arm is outside of the catch in the auxiliary locking bar and a second position where the one arm in within the catch of the auxiliary locking bar; and the catch of the auxiliary locking bar and the opening there through being spaced from each other a distance such that, when the one arm is locked within the catch of the auxiliary locking bar, the lower end portion of the second shackle arm cannot be flexed toward the first shackle arm a distance sufficient to permit the lower end portion of the second shackle arm to be pivoted out of the catch means of the base block.

12. The locking assembly according to claim 11, wherein:

the auxiliary locking bar is removably mounted on the shackle.

13. The locking assembly according to claim 12, wherein:

the catch is a slot in the auxiliary locking bar passing from the first to the second surface of the auxiliary locking bar and opening onto one of the lateral surfaces of the auxiliary locking bar.

14. The locking assembly according to claim 11, wherein:

the catch is a slot in the auxiliary locking bar passing from the first to the second surface of the auxiliary locking bar and opening onto one of the lateral surfaces of the auxiliary locking bar.

15. The locking assembly according to claim 11, wherein:

the keyed locking mechanism is a cylinder lock with a cam actuated closure bar for retaining the received shackle arm within the catch of the auxiliary locking mechanism.

* * * * *